US005107817A

United States Patent [19]

Dittmann et al.

[11] Patent Number: 5,107,817

[45] Date of Patent: Apr. 28, 1992

[54] METHOD OF ASSOCIATING IGNITION SIGNALS WITH A REFERENCE CYLINDER

[75] Inventors: Karl-Heinz Dittmann, Eislingen; Andreas Böttigheimer, Neuffen; Dieter Nemec, Heiningen, all of Fed. Rep. of Germany

[73] Assignee: Robert Bosch GmbH, Stuttgart, Fed. Rep. of Germany

[21] Appl. No.: 730,774

[22] PCT Filed: Jan. 11, 1990

[86] PCT No.: PCT/DE90/00010

§ 371 Date: Jul. 24, 1991

§ 102(e) Date: Jul. 24, 1991

[87] PCT Pub. No.: WO90/08894

PCT Pub. Date: Aug. 9, 1990

[30] Foreign Application Priority Data

Jan. 26, 1989 [DE] Fed. Rep. of Germany ..... 3902254

[51] Int. Cl.[5] ..... F02P 5/145; F02P 15/08

[52] U.S. Cl. ..... 123/643; 123/636; 123/644

[58] Field of Search ..... 123/609, 636, 643, 644

[56] References Cited

U.S. PATENT DOCUMENTS

| | | | |
|---|---|---|---|
| 4,478,201 | 10/1984 | Asik | 123/643 X |
| 4,483,293 | 11/1984 | Akasu | 123/643 |
| 4,711,227 | 12/1987 | Li et al. | 123/643 |
| 4,913,123 | 4/1990 | De Biasi et al. | 123/609 |
| 4,915,086 | 4/1990 | Ciliberto et al. | 123/644 X |
| 5,058,560 | 10/1991 | Asakura et al. | 123/644 X |
| 5,065,729 | 11/1991 | Krauter et al. | 123/643 |

FOREIGN PATENT DOCUMENTS

| | | | |
|---|---|---|---|
| 0272225 | 6/1988 | European Pat. Off. . | |
| 3325308 | 1/1985 | Fed. Rep. of Germany . | |
| 2090914 | 7/1982 | United Kingdom | 123/636 |
| 8908778 | 9/1989 | World Int. Prop. O. . | |

*Primary Examiner*—Willis R. Wolfe

*Attorney, Agent, or Firm*—Frishauf, Holtz, Goodman & Woodward

[57] ABSTRACT

Methods for associating ignition signals with a reference cylinder in multiple-spark ignition systems of internal combustion engines with externally supplied ignition are proposed; different signal levels for the primary and supporting sparks are used in a first method, and the time offset between the primary and supporting spark onsets is used in a second method for the association.

7 Claims, 1 Drawing Sheet

METHOD OF ASSOCIATING IGNITION SIGNALS WITH A REFERENCE CYLINDER

BACKGROUND OF THE INVENTION

The invention is based on a method for associating ignition signals with a reference cylinder in multiple-spark ignition systems of internal combustion engines having externally supplied ignition.

To make the performance of precise testing of the ignition system of internal combustion engines possible, synchronization of the ignition system test unit with a reference signal is required. In ignition systems having a distributor, the ignition at the reference cylinder is detected with the aid of a trigger signal pickup, which is connected by means of the ignition cable leading to the reference signal, and is passed on to the ignition system test unit for evaluation and synchronization.

This method is unsuitable for multiple-spark ignition systems, because there is no mechanical distributor. In such ignition systems, a number of double-spark ignition coils corresponding to half the number of cylinders is used; these coils have two separate high-voltage windings, or preferably one such winding, which then generates two high-voltage signals of unlike polarity. It is also possible, however, to assign one ignition coil to each spark plug, with two or more ignition coils generating ignition pulses simultaneously. Ignition takes place in only one cylinder in the working stroke, while in the other cylinders, the ignition sparks remain without effect. The actual ignition spark is called the primary spark, while the other ignition spark is called the supporting spark.

In such ignition systems, the association of the ignition signals with a reference cylinder with the aid of a trigger signal pickup connected to the ignition cable leading to the reference signal is ambiguous, because the pickup outputs a signal both for the primary spark and for the supporting spark. Unequivocal synchronization of the ignition system test unit with the ignition signals for the reference signal would thus not be possible.

German Patent 33 25 308 discloses an ignition signal adaptor for distributorless ignition systems of internal combustion engines with externally supplied ignition, in which the signals detected by trigger tongs clamped to the two ignition lines connected to a double-spark ignition coil are delivered to a synchronizing stage, at the output of which the pulse train of actual ignition pulses is output for either one or the other cylinder. Synchronization with the actual ignition pulses in the reference signal is effected by depressing a key, which causes the output signal to switch over from one pulse train to the other.

ADVANTAGES OF THE INVENTION

The method according to the invention has the advantage that the association of ignition signals with a reference signal takes place automatically. Within a certain engine operating range, the primary and supporting sparks generated in double-spark ignition coils are distinguished by the magnitude of the ignition voltages. Since the compression and both the mixture present and the mixture dynamics vary in the working stroke and in the exhaust stroke, the primary spark generally requires a substantially higher ignition voltage than the supporting spark.

In a first exemplary embodiment of the method according to the invention, it is provided that the association of ignition signals with a reference signal is ascertained from a comparison of the level of the high-voltage signals occurring at the reference signal with a reference level derived from the high-voltage signals. In an advantageous feature of the first exemplary embodiment, it is provided that the reference level is ascertained from the signals having a lower level in comparison with the levels of the preceding signals.

Both the ignition voltage occurring at the reference signal, which is for instance picked up by a capacitive transducer, and the spark current detectable by an inductive transducer, which is measurable after ignition, are suitable for evaluating the signal level.

In a second, particularly advantageous exemplary embodiment, it is provided that the association of ignition signals with a reference cylinder is ascertained from the timing offset between the ignition spark onset at the reference cylinder and the ignition spark onset at the other cylinder. In the second exemplary embodiment as well, the varying ignition voltage requirement for the primary and supporting sparks is exploited for association purposes in a certain operating range of the engine. For instance, the onset of the rise in ignition voltages of the primary and supporting sparks is tripped by interrupting the flow of current in the primary circuit of the ignition coil. Since this voltage rise cannot take place infinitely fast, the lower ignition voltage of the supporting spark is attained chronologically before the higher ignition voltage of the primary spark.

An advantageous feature provides that the ignition spark onset at one of the two cylinders trips a timing signal with a predeterminable duration, and that the reference cylinder is ascertained from the presence or absence of the ignition signal of the other cylinder within the time interval.

The advantage of the second exemplary embodiment is, in particular, that the absolute values for the signals, for instance the amplitudes, are not needed.

In contrast to the first exemplary embodiment, instead of only the signals occurring at one spark plug, the signals occurring at least two spark plugs are evaluated, which increases the reliability of measurement.

In this exemplary embodiment as well, both an inductive transducer for detecting the spark current after the onset of ignition and a capacitive transducer for detecting the voltage upon the onset of ignition are equally suitable.

A particularly advantageous further feature of the method according to the invention in accordance with the two exemplary embodiments becomes possible because the association of ignition signals with a reference cylinder is carried out in a predetermined engine operating range, and because this association is maintained upon a departure from this range. At certain engine speeds, or in overrunning, for instance, the levels of the high-voltage signals may temporarily be of equal magnitude. Advantageously, the association is performed in an operating range, such as engine idling, in which the signals are markedly different. As a function of the rotary speed signal detected, or in the presence of overrunning, it is provided that the association is maintained until such time as the certain suitable operating range for synchronization is again attained.

Further advantageous features of and improvements to the method according to the invention will become apparent from further dependent claims in combination with the ensuing description.

DRAWINGS

FIG. 1 illustrates a block circuit diagram of a multiple-spark ignition system, and FIG. 2 illustrates, as a function of time, five signal courses which occur in the circuit shown in FIG. 1.

DETAILED DESCRIPTION OF THE EXEMPLARY EMBODIMENTS

Figure 1:
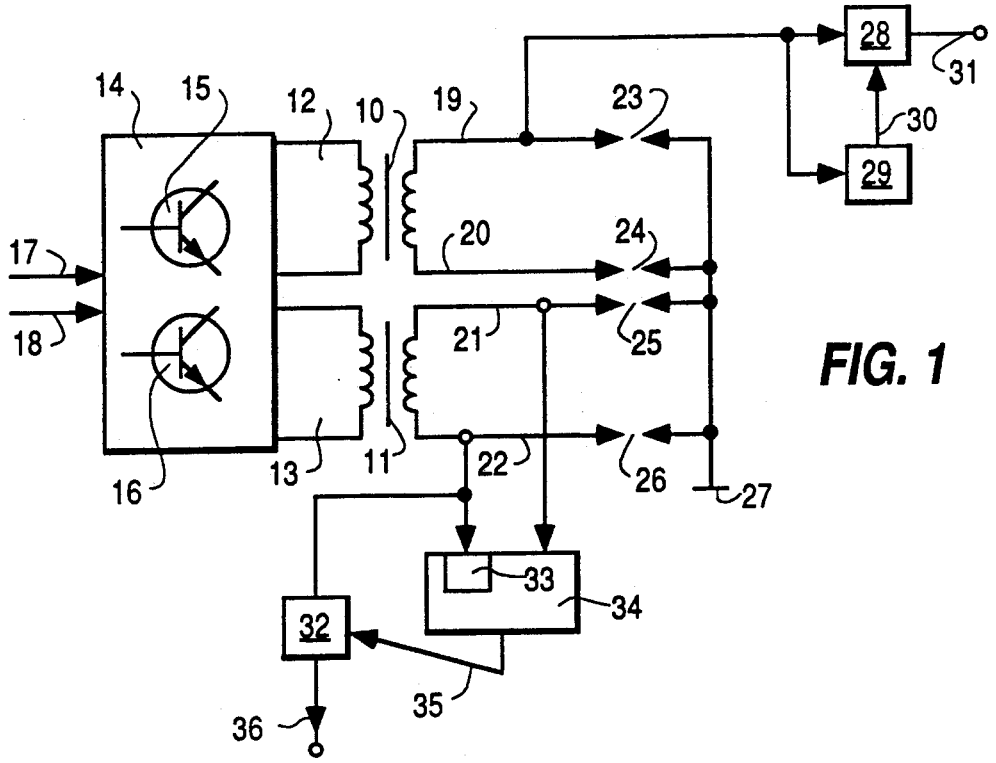

FIG. 1 shows an ignition system for internal combustion engines with externally supplied ignition, which includes two double-spark ignition coils 10, 11. Instead of the double-spark ignition coils 10, 11, a plurality of ignition coils, each having one high-voltage winding, which generate ignition pulses simultaneously, may also be used. The primary sides 12, 13 of the ignition coils 10, 11 are connected to an ignition control unit 14, which has one electrically triggerable switch 15, 16, shown in FIG. 1 in the form of transistor symbols, for each ignition coil 10, 11. The ignition control unit 14 is supplied with control signals via input lines 17, 18.

The two secondary terminals 19, 20 of the ignition coil 10 and the secondary terminals 21, 22 of the ignition coil 11 each lead to spark plugs 23, 24, 25, 26 which are each connected to ground 27. Instead of one secondary winding, two or more secondary windings on one coil 10, 11 may also be provided. The secondary terminal 19 is connected to both a first frequency divider 28 and a first synchronizing stage 29. The first synchronizing stage 29 emits a signal to the first frequency divider 28 via a first control line 30. A signal that indicates every other high-voltage pulse appearing at the secondary terminal 19 can be picked up at the output 31 of the first frequency divider 28.

The secondary terminal 22 of the double-spark ignition coil 11 is connected to both a second frequency divider 32 and a timer 33, which is part of a second synchronizing stage 34. The secondary terminal 21 is carried directly to the second synchronizing stage 34. The second synchronizing stage 34, via a second control line 35, emits signals to the second frequency divider 32. A signal that indicates the appearance of every other high-voltage pulse at the secondary terminal 22 can be picked up at the output 36 of the secondary frequency divider 32.

The operation of the double-spark ignition coil system shown in FIG. 1, as an example of a multiple-spark ignition system, and the method according to the invention for associating ignition signals with a reference signal will be described in further detail, in conjunction with the signal courses shown in FIG. 2.

Figure 2:
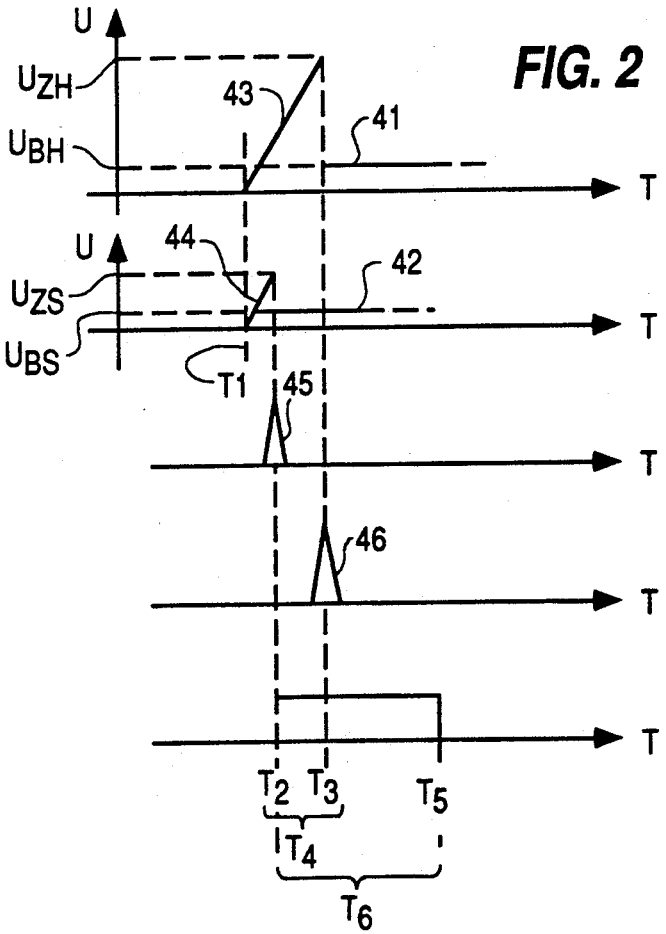

The first two signal courses 41, 42 shown in FIG. 2 represent high-voltage signals, measurable at the spark plugs 23, 26 as a function of the time T. The signal course 41 represents the high-voltage signal upon ignition of a primary spark, and the signal course 42 represents the high-voltage signal upon ignition of a supporting spark. At a time T1, the switch 15, for instance, opens. The abrupt variation in current on the primary side 12, for example of the double-spark ignition coil 10, results in steep voltage rises 43, 44 on the secondary side of the ignition coil 10. The voltage rise 43 continues, until the ignition voltage of the primary spark $U_{ZH}$ at one of the spark plugs 23, 24 is reached, at a time T3. After that, the voltage breaks down to the operating voltage $U_{BH}$ of the primary spark. The voltage rise 44 ends upon attainment of the ignition voltage of the supporting spark $U_{ZS}$ at time T2. This voltage thereupon breaks down to the operating voltage $U_{BS}$ of the supporting spark.

According to the first exemplary embodiment, the dissimilarly high ignition voltage requirement $U_{ZH}$ of the primary spark in comparison with that of the supporting spark $U_{ZS}$ is exploited for associating the ignition signals 41, 42 with a reference cylinder. This method will be described in terms of the arrangement 28, 29 connected to the secondary terminal 19 of the double-spark ignition coil 10.

It is assumed that the spark plug 23 is provided for ignition of the mixture of gas and fuel introduced into a reference cylinder. The signal appearing at the secondary terminal 19 of the ignition coil 10 is delivered to the first frequency divider 28. A galvanic connection with the ignition line, for instance, is possible. Preferably, either a capacitive or inductive signal transducer is used. The capacitive transducer is connected via the ignition cable, and with the cable insulation acting as a dielectric forms a capacitor of low capacitance, by way of which alternating voltages can be passed onward. The inductive transducer detects the current flowing in the ignition cable, which begins at the instant of the spark discharge T2, T3 and continues over the duration of spark burning. Only the current onset at the ignition instants T2, T3 is of interest here. The capacitive transducer reproduces the relative course of the high-voltage signals 41, 42, while the amplitude ratios $U_{ZH}/U_{BH}$ are being maintained. The direct evaluation of the signal amplitudes is thus possible with the capacitive transducer. The current detected by the inductive transducer also has different amplitudes for the primary and supporting sparks. The higher ignition voltage $U_{ZH}$ results in a greater breakthrough current than the lower ignition voltage $U_{ZS}$ of the supporting spark, so that the signals detected by the inductive transducer can likewise be used as a measure of the signal courses 41, 42 from times T2, T3 on.

At its output 31, the first frequency divider 28 generates a pulse train the frequency of which is half as high as the frequency of the pulse train of input signals. This division of the frequency by two is necessary, because primary and supporting sparks occur at the spark plug 23, yet only the primary sparks appearing upon ignition of the reference signal are to be evaluated An input circuit of the first frequency divider 28 is designed such that each input pulse is counted, regardless of the signal amplitude. Synchronization of the pulses appearing at the output 31 of the first frequency divider 28 with the primary sparks appearing at the spark plug 23 is made possible by the first synchronizing stage 29. The synchronizing stage 29 evaluates the amplitude of the signal appearing at the spark plug 23 and controls the first frequency divider 28 accordingly, via the line 30. If the amplitude exceeds or drops below a reference level, this fact is used in order to put a counter, contained in the first frequency divider 28, into a starting state.

In an advantageous feature of the first exemplary embodiment, it is provided that the reference signal is ascertained from the signals of lower level compared with the levels of the various preceding signals. In this way, adaptive accommodation of the reference level to the actual amplitude ratios is possible.

In the second method, the timing offset between the ignition onset T2 of the supporting spark and the ignition onset T3 of the primary spark is utilized for associating ignition signals with a reference cylinder. This method will be described in conjunction with the arrangement connected to the secondary terminals 21, 22 of the double-spark ignition coil 11.

The voltage course 41 shown in FIG. 2 is assumed to appear at the spark plug 25, and the signal course 42 is assumed to appear simultaneously at the spark plug 26. Accordingly, the primary spark occurs at the spark plug 25 in this working stroke of the engine. The voltage amplitudes $U_{ZH}$, $U_{ZS}$ play no role here. The essential feature is that the instants T2, T3 of ignition be recognized. Although an electrical connection between the secondary terminals 21, 22 and the second frequency divider 32 and second synchronizing stage 34, respectively, would be possible in this method as well, once again preferably two inductive or capacitive transducers would be used. Both types of transducer can be driven such that the needle pulses 45, 46 shown in FIG. 2 each occur at the ignition spark onset T2, T3. The spark plug 25 is assumed to be the spark plug provided for firing the reference cylinder. The signal that can be picked up at the spark plug 26 is delivered to the second frequency divider 32, which at its output 36 outputs a pulse train the frequency of which is divided in half compared with the frequency of the input pulse train. An association of the pulse train that can be picked up at the output 36 with the primary spark of the spark plug 26 is performed with the second synchronizing stage 34. Each pulse that can be picked up at the spark plug 26 and is carried to the timer 33 starts a time interval T6, which begins at the appearance of the pulse at time T2 and is ended at time T5 and can be predetermined by the timer 33. The second synchronizing stage 34, via the line 35, outputs a synchronizing signal whenever the ignition spark onset appears at the other spark plug 25 within the time interval T6. An appearance of the ignition spark onset, as here by way of example, means that the primary spark has appeared at the spark plug 25. If no ignition spark onset is recorded, then the primary spark has occurred at the spark plug 26.

Suitably, the time interval T6 is selected to be shorter than the time intervals, corresponding to the maximum possible engine speed, between two ignition events.

In an advantageous feature of both methods according to the invention, it is provided that the association is performed in a predeterminable operating range of the engine, and that this association is maintained upon a departure from this range. The high-voltage courses 41, 42 shown for the primary and supporting sparks applies for a wide engine operating range. At certain engine speeds, usually at full load and in overrunning, the amplitudes of the two signals 41, 42 may be temporarily of equal magnitude or may even vary inversely. To prevent incorrect synchronization in these operating states, locking of the first synchronizing stage 29 or second synchronizing stage 32 can be provided. The locking is effected for instance as a function of a rotary speed signal or a fuel flow signal. In the evaluation of the rotary speed signal, locking during a speed variation is also especially advantageous.

What is claimed is:

1. A method of associating ignition signals with a reference signal in a multiple-spark ignition system of an internal combustion engine with externally supplied ignition, characterized in that the association is ascertained from the timing offset between the ignition spark onset (T3) at a spark plug (25) assigned to the reference signal and the ignition spark onset (T2) at a spark plug (26) assigned to at least one further cylinder.

2. The method of claim 1, characterized in that the ignition spark onset (T2) at a spark plug (26) trips a timer (33) having a predetermined time period (T6), and that the reference cylinder is ascertained from the presence or absence of the ignition onset of at least one further spark plug (25) within the time period (T6).

3. The method of claim 1, characterized in that the high-voltage signal courses (41, 42) are picked up with at least one inductive transducer at the secondary terminals (19, 22) of the ignition coils (10, 11).

4. The method of claim 1, characterized in that the high-voltage signal courses (41, 42) are picked up with at least one capacitive transducer at the secondary terminals (19, 22)) of the ignition coils (10, 11).

5. The method of claim 1, characterized in that the association of the ignition signals with a reference cylinder is performed in a predeterminable operating range of the engine, and this disassociation is maintained upon a departure from this range.

6. The method of claim 5, characterized in that a locking of the association is performed as a function of at least one of the engine speed and a transducer signal corresponding to the engine load state.

7. The method of claim 6, characterized in that the associating is maintained as long as the engine speed is varying.

* * * * *